United States Patent [19]

Mitchell

[11] Patent Number: 4,909,580

[45] Date of Patent: Mar. 20, 1990

[54] FABRIC DRYER HOUSING

[75] Inventor: Thomas P. Mitchell, Louisville, Ky.

[73] Assignee: General Electric Company, Louisville, Ky.

[21] Appl. No.: 255,380

[22] Filed: Oct. 11, 1988

[51] Int. Cl.[4] ..... A47B 91/00

[52] U.S. Cl. ..... 312/256; 312/228; 312/257.1

[58] Field of Search ..... 312/228, 256, 257 R, 312/257 A, 257 SM

[56] References Cited

U.S. PATENT DOCUMENTS

| | | | |
|---|---|---|---|
| 3,365,535 | 1/1968 | Wilk | 174/50 |
| 3,786,765 | 1/1974 | Burr | 108/60 |
| 4,325,594 | 4/1982 | Lang et al. | 312/257 A X |
| 4,336,619 | 6/1982 | Hinkel et al. | 312/228 X |
| 4,572,596 | 2/1986 | Weir et al. | 312/257 R |
| 4,618,193 | 10/1986 | Cuthbert et al. | 312/257 SM |

*Primary Examiner*—Joseph Falk
*Attorney, Agent, or Firm*—Radford M. Reams; Frederick P. Weidner

[57] ABSTRACT

A fabric dryer cabinet includes a simplified, multi-purpose assembly for mounting the front panel to the main body of the cabinet. The assembly includes two leveling leg support members welded, in spaced apart relationship, to a shield. Each support member has an upwardly extending tab and a threaded lug to receive a support leg. The assembly is joined to the lower front of the cabinet main body. The front panel has side flanges with lower lips having mounting holes. The tabs engage the holes to urge the front panel toward the cabinet main body when the front panel is placed on the assembly. The main body side panels and the front panel have mating guides and openings to assure the front panel registers with the side panel.

7 Claims, 2 Drawing Sheets

FIG. 1
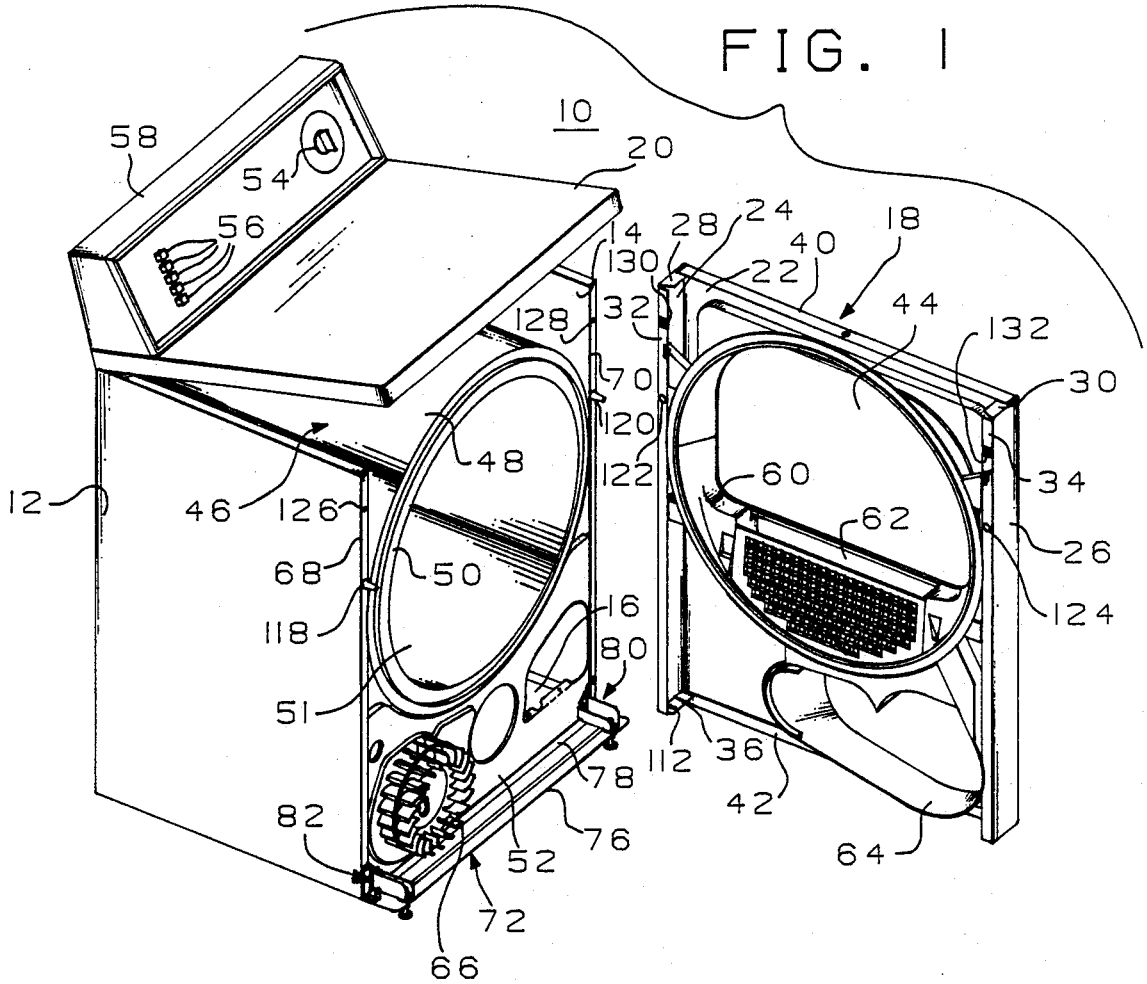
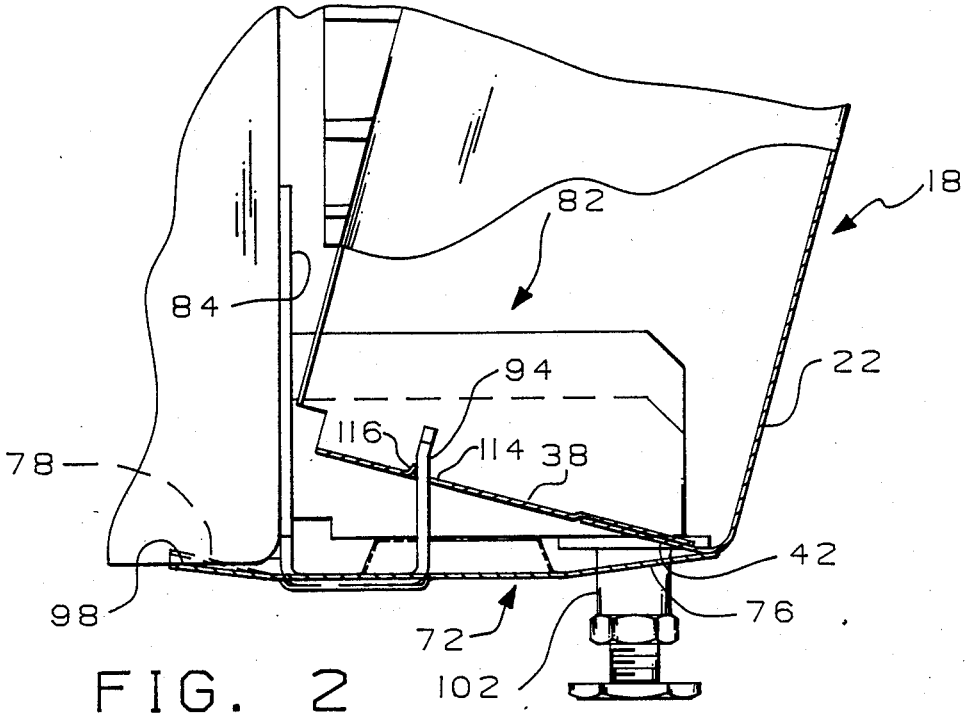
FIG. 2

FABRIC DRYER HOUSING

BACKGROUND OF THE INVENTION

Typical fabric dryers, such as automatic clothes dryers, include a cabinet or housing which encloses the various operating components. It is desirable to provide adjustable leveling legs or feet adjacent the front corners of the cabinet to compensate for any unevenness of the floor on which the dryer is mounted. In addition, it has become popular to make dryers "front serviceable." That is, to enable the user or serviceman to make at least most repair through the front of the dryer. To facilitate front serviceability it is desirable to provide a cabinet in which the front panel easily may be removed and remounted. Also, it often is desirable to provide a recesses of the lower front of the cabinet, called a kick space, so the user can stand closer to the dryer when operating it.

By my invention I provide a clothes dryer with a new, simplified assembly that provides quick but stable mounting of the front panel and easy access for field service while, at the same, time providing a sturdy mount for the leveling legs and a kick space when desired.

SUMMARY OF THE INVENTION

In accordance with the form of the invention there is provided a fabric dryer including a cabinet having a main body, including a rear panel and a pair of spaced apart side panels joined to said rear panel, and a front panel for closing the space between the front edges of the side panels. The front panel includes a front wall and a pair of rearwardly projecting side flanges. Each side flange has an inwardly projecting lip along its lower edge and each lip includes a mounting opening. A mounting assembly for removably positioning the front panel adjacent the main body includes a pair of leveling leg support members welded to an elongated shield and joined to the cabinet main body. Each support member includes an upwardly extending, flexible tab. Each tab is received in a corresponding mounting opening when the front panel is positioned adjacent the main body for urging the front panel toward the side panels. A leveling leg is adjustably mounted in each support member.

BRIEF DESCRIPTION OF THE DRAWINGS

FIG. 1 is a front perspective view of a clothes dryer incorporating one form of the present invention, with the top partly raised and the front panel folded out to illustrate details and is somewhat schematic in form for ease of reference.

FIG. 2 is a fragmentary side elevational view of the lower front corner of the dryer of FIG. 1, partly broken away and illustrating the front panel partially seated on the mounting assembly.

DESCRIPTION OF THE PREFERRED EMBODIMENTS

Figure 3:
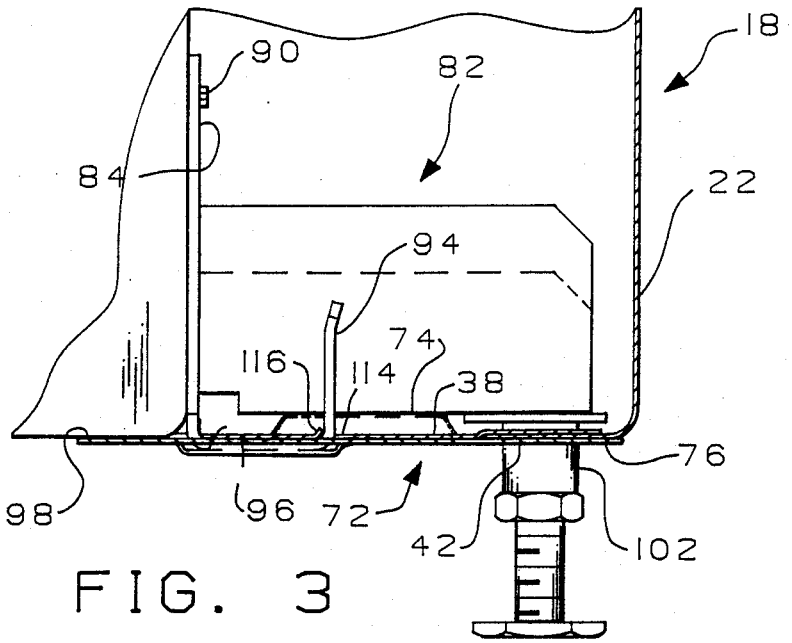
FIG. 3 is a fragmentary side elevational view similar to FIG. 3, but with the front panel fully seated.

Referring now to the drawings, in particular to FIG. 1, there is illustrated a domestic fabric or clothes dryer generally indicated by the numeral 10. The dryer includes a cabinet or housing having a rear panel (not shown), a pair of spaced apart side panels 12 and 14 and a bottom panel 16, making up the main body of the housing. The housing also includes a front panel 18 and a top or a cover 20. The front panel is formed as a separate member and, when desired, is slightly shorter than the rear and side panels so as to be supported on a mounting assembly at the front of the bottom panel or pan 16. This provides space below the bottom of the front panel, normally called a kick space.

The front panel 18 includes a front wall 22, a pair of rearwardly projecting side flanges 24 and 26 terminating in inwardly projecting lips 28 and 30 respectively at their tops 32 and 34 respectively at their vertical edges facing the main body and 36 and 38 respectively on their lower edges. The front wall 22 also has a top lip 40 and a bottom lip 42. The front wall 22 is formed with an opening 44 to provide access to the interior of the dryer. The door normally mounted on the front wall 22 to selectively close the opening 44 has been omitted from the drawings for the sake of simplicity.

A fabric tumbling chamber or drum 46 is mounted for rotation around a substantially horizontal axis within the housing. The drum 46 is generally cylindrical in shape, having an imperforate outer cylindrical wall 48 and a front flange or wall 50 defining an opening 51 to the drum. When the dryer is assembled the drum opening 51 registers with the opening 44 in the front panel, permitting clothes or other fabrics be loaded into and removed from the dryer. A plurality of clothes tumbling ribs (not shown) normally are provided on the interior of the wall 48 to lift fabrics and then allow them to tumble back to the bottom of the drum as the drum rotates.

The drum 46 conventionally includes a rear wall (not shown) which is rotatably supported within the cabinet by a suitable fixed bearing. The front of the drum is rotatably supported by a support panel 52. Conventionally rollers or slides of low friction material (not shown) are mounted on the panel 52 and rotatably support the front of the drum. The panel 52 is mounted in alignment with the front edges of the side panels 12 and 14 and is attached to them and to the bottom pan 16 to contribute structural strength and stiffness to the housing. Conventionally air for drying the fabrics is heated either by electrical resistance heaters or a gas fueled heat exchanger. A blower draws the heated air through the drum to evaporate moisture from the fabrics in the drum and then expels the hot moist air out of the housing and through a conduit to the outside atmosphere. As the heated air is drawn through the drum the drum is rotated, conventionally by means of an electric motor. The operation of these various components are controlled by control means such as timer 54 and switches 56 mounted in the backsplash 58 at the rear of top panel 20. These various operating components are conventional in nature and their details have been omitted for the sake of simplicity.

The space between the front flange 50 of the drum 46 and the front wall 22 of the front panel 18 is bridged by an intermediate member 60. The intermediate member provides a flange bridging between the opening 44 in the front wall and the drum opening 51 so that fabrics being put into or removed from the dryer do not fall into the equipment compartment. It further defines a pocket 62 to receive a filter for removing lint from the air exiting from the drum. Finally it has a rim 64 which mates with the intermediate member 52 to define a housing for the blower wheel 66.

Figure 4:
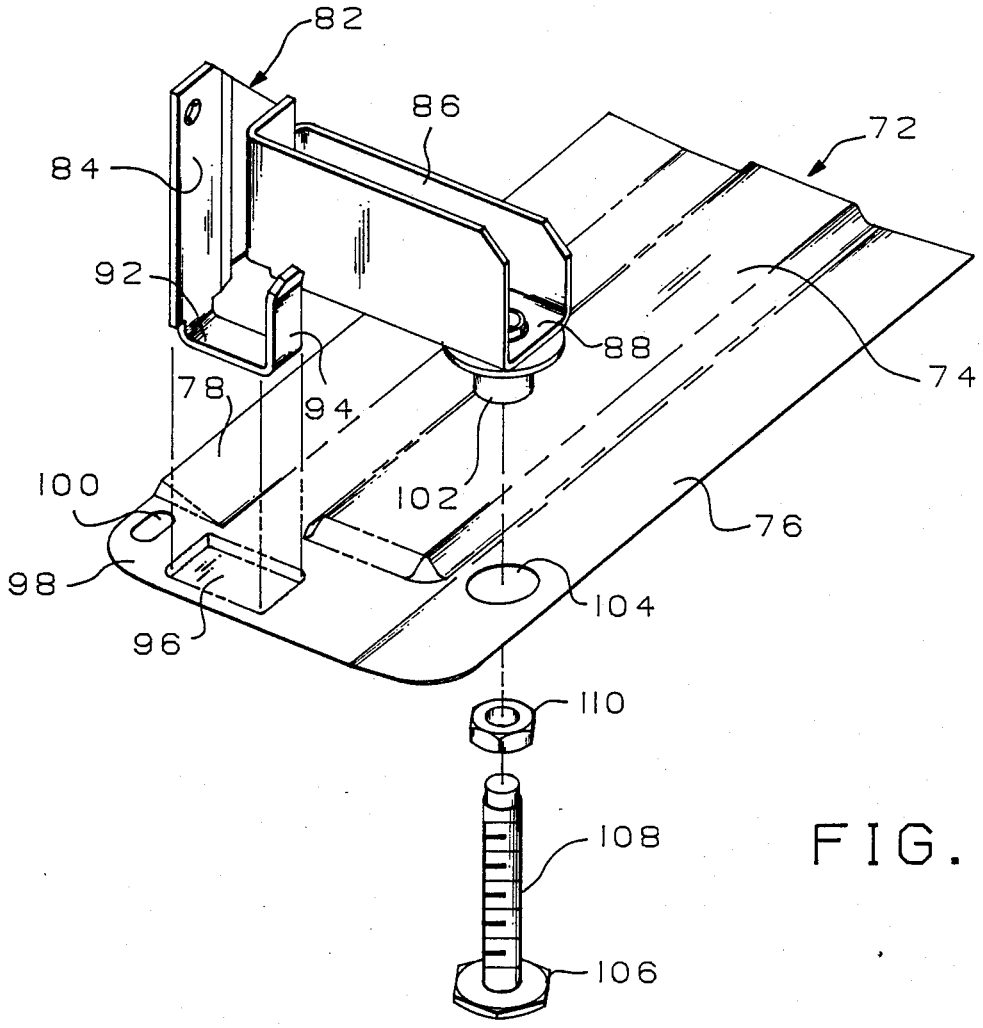
FIG. 4 is a exploded perspective view illustrating one end of the mounting assembly incorporated in the clothes dryer of FIG. 1.

A mounting assembly for supporting the front panel adjacent to the main body of the housing and with the inwardly extending vertically disposed lips 32 and 34 of the front panel in register with the inwardly extending vertically disposed lips 68 and 70 of side panels 12 and 14 respectively is best illustrated in FIGS. 1 and 3. The mounting assembly includes a elongated sheet 72 of suitable material such as a thin metal. The sheet is formed with a raised elongated center rib 74 and a pair of elongated flaps 76 and 78 which extend longitudinally of the rib 74 and are bent or canted upwardly. The assembly also includes a pair of leveling leg support members 80 and 82. As is best seen in FIG. 4 each leg support member includes a generally triangular base 84 with a leg support 86 extending outwardly therefrom. Each leg support 86 is generally U-shaped in cross-section and includes a flat bottom 88. Each leg support bottom 88 is attached or joined to the shield or brace 72 by welding the leg support bottom 88 to the raised rib 72. As is seen in FIG. 1 the support members 80 and 82 are welded to the shield 72 in a spaced apart configuration so as to come into register with the outer lower corners of the main body of the cabinet. That is, the bases 84 of the support members overlie the bottom of the side panels 14 and 16 and the laterally outer portions of the bottom pan 16 and are attached thereto by suitable means such as screws 90. Each support member also includes an L-shaped extension having a base 92 and a generally upwardly extending tab 94.

In order for the front panel 18 to fit tightly against the shield 72, the base 92 is lower than the leg support bottom 88, the raised center rib 74 of the shield terminates short of each end of the shield and each end is provided with an elongated recess, such as that shown at 96, into which the corresponding base 92 fits. Each end of the flap 78 is provided with a offset ear 98 which will bears against the bottom of the corresponding side panel when mounted as shown in FIG. 1. If desired, these ears may be provided with openings 100 through which screws extend to attach the flap 78 to each of the side panels. A threaded lug 102 is formed as part of or is attached to each leg support 86 and the flap 76 is provided with an opening 104 in register with each lug 102. A pair of support legs, in the form of feet 106 and threaded shafts 108, are fed through the openings 104 and threadedly engaged in the lugs 102. A nut 110 is carried on each shaft 108 and when the dryer has been leveled by adjusting the height of the feet 106 the nuts 110 are tightened against the corresponding lugs 102 and prevent further rotation of the shafts 108.

The bottom lips 36 and 38 of the front panel 18 are provided with mounting openings 112 and 114 respectively. Preferably these openings are formed by lancing the lips to provide a flap 116 in the metal forming the lip with the flap being attached to the lip at the edge of the opening toward the main body of the cabinet. In assembling the front panel 18 to the main body of the cabinet, the panel is tilted generally as shown in FIG. 2 and placed next to the mounting assembly with the tabs 94 extending into the mounting openings 112 and 114. The front panel is then rotated counter clockwise to the position shown in FIG. 3, in which the bottom lips 36 and 38 rest against the shield 72. The engagement of the tabs 94 in the openings 112 and 114 urge the front panel toward the main body of the housing. The existence of the metal flaps 116 enhance this action.

As seen in FIG. 1 each of the side panels 12 and 14 has a tapered guide 118 and 120 respectively extending forwardly of the front lips 68 and 70. The lips 32 and 34 on the front panel 18 have corresponding guide openings 122 and 124 respectively. As the front panel is pivoted toward the main body of the cabinet the tapered guides enter the guide openings and assure that the lips 32 and 34 come into register with the lips 68 and 70 so that the front panel is properly aligned with the main housing. After the front panel has been moved into place screws may be inserted through openings 126 and 128 in the side panels 12 and 14 and threadedly received in spring clips 130 and 132 in the lips 32 and 34 of the front panel 18. This releaseably secures the front panel to the main body of the cabinet. Then the top may be lowered and secured in any suitable manner.

The shield 72 and lower edge of front panel 18 provide a "kick space" to accommodate the feet of a user. If it becomes necessary to repair the dryer the top may be lifted and the screws removed from the clips 130 and 132. Then the front panel may be rotated in a clockwise direction, as seen in FIGS. 2 and 3, and removed from the main body of the cabinet. This quickly and easily exposes most of the operating components for service. At the end of the service the front panel and top may be replaced in the same manner as in the original construction.

The foregoing is a description of preferred embodiment of the present invention. In accordance with the patent statutes, changes may be made in the disclosed construction in the method in which it is employed without actually departing from the true spirit and scope of the invention as defined in the appended claims.

I claim:

1. A fabric dryer including:

a cabinet having a main body including a rear panel, a pair of spaced apart side panels joined to said rear panel and a bottom panel substantially closing the area within the lower edges of said rear and side panels, and a front panel for closing the space between the front edges of said side panels;

said front panel including a front wall and a pair of rearwardly projecting side flanges; each of said flanges having an inwardly projecting lip formed along its lower edge, each of said lips defining a mounting opening therein;

a mounting assembly fixedly attached to said main body for removably positioning said front panel adjacent said main body; said assembly including a pair of support members respectively positioned adjacent each of said side panels;

each of said support members including an upwardly extending, flexible tab; each tab being received in a corresponding mounting opening when said front panel is positioned adjacent said main body for urging said front panel toward said side panels;

a shield extending between and attached to said support members, said shield also extending between and engaging said bottom panel and the lower edge of said front panel and;

a pair of threaded leveling legs, each of said support members having a threaded lug to receive a corresponding one of said legs.

2. A fabric dryer as set forth in claim 1, wherein said mounting assembly further includes an elongated brace extending between and joined to said support members.

3. A fabric dryer as set forth in claim 1 wherein: said shield is formed from a sheet of material having an elongated central rib attached to said supporting members; and a pair of elongated flaps flanking said central rib; each of said flaps having an upward cant to assure that said shield firmly engages said bottom panel and the lower edge of said front panel.

4. A fabric dryer as set forth in claim 3 wherein: said shield defines a pair openings to accommodate said leveling legs.

5. A fabric dryer as set forth in claim 1 wherein: each mounting opening is formed by lancing the corresponding lip to form a finger attached to said lip at the edge of the mounting opening toward said main body, whereby each of said fingers engages the corresponding one of said tabs to resiliently urge said front panel towards the corresponding side panel.

6. A fabric dryer as set forth in claim 1 wherein: the front edge of each of said side panels is formed with an inwardly projecting vertical lip, each of said front panel flanges is formed with an inwardly projecting, vertical lip; and guide means is positioned to assure that said vertical lips of said flanges come into register with the corresponding vertical lips of said side panels as said front panel is mounted on said support members.

7. A fabric dryer as set forth in claim 6 wherein said guide means includes a tapered guide attached to each of a first pair of said vertical lips and received in an alignment opening in each of the other pair of vertical lips.

* * * * *